US005150790A

United States Patent [19]

Forgette

[11] Patent Number: 5,150,790

[45] Date of Patent: Sep. 29, 1992

[54] THEFT GUARD FOR CABLE REELS

[76] Inventor: Sidney M. Forgette, 20 Standish St., Plattsburgh, N.Y. 12901

[21] Appl. No.: 734,486

[22] Filed: Jul. 23, 1991

[51] Int. Cl.[5] ..... B65D 85/67

[52] U.S. Cl. ..... 206/4; 206/53

[58] Field of Search ..... 206/398, 399, 400, 53

[56] References Cited

U.S. PATENT DOCUMENTS

| | | | |
|---|---|---|---|
| 1,243,229 | 10/1917 | Shonberg | 206/400 |
| 1,319,552 | 10/1919 | Wolfermann et al. | 206/400 |
| 2,397,087 | 3/1946 | Camras | 206/53 |
| 2,792,185 | 5/1957 | Julliard | 206/53 X |
| 3,287,777 | 11/1966 | Cranwill | 206/53 |
| 3,490,579 | 1/1970 | Kulka | 206/53 |
| 4,850,487 | 7/1989 | Robertson | 206/399 |

*Primary Examiner*—Bryon P. Gehman

*Attorney, Agent, or Firm*—Warren N. Low; Renee S. Rutkowski; James W. Fitzsimmons

[57] ABSTRACT

A cable guard for a pay-out reel, preferably in the form of an adjustable length flexible belt adapted to be wrapped around a partially paid out reel of cable and to be removably secured to the reel while surrounding a single section of the cable, thereby preventing cable from being paid out from the reel while the cable guard is in place.

15 Claims, 3 Drawing Sheets

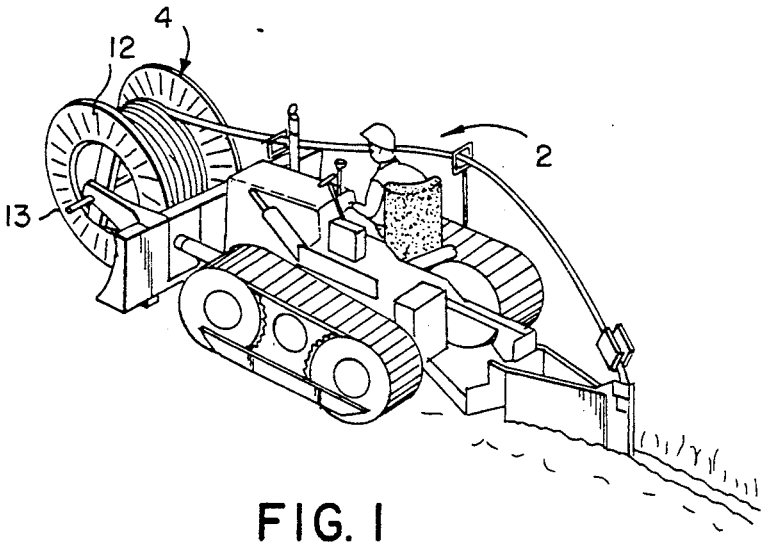
FIG. 1
FIG. 2
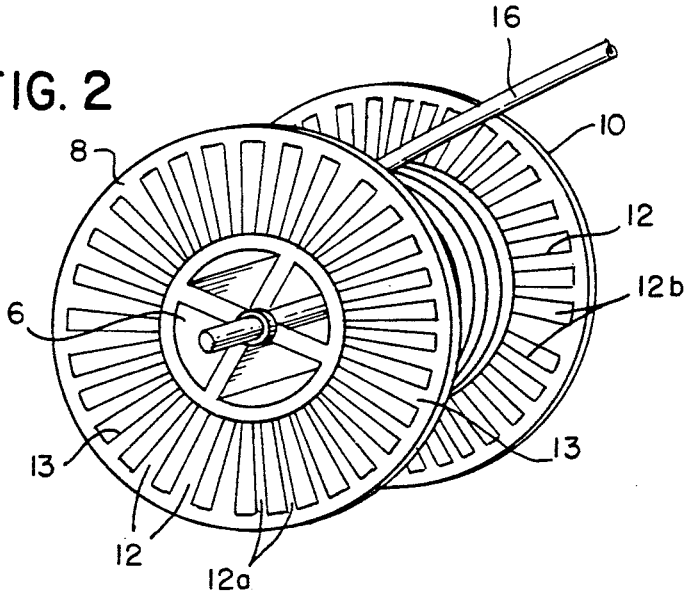

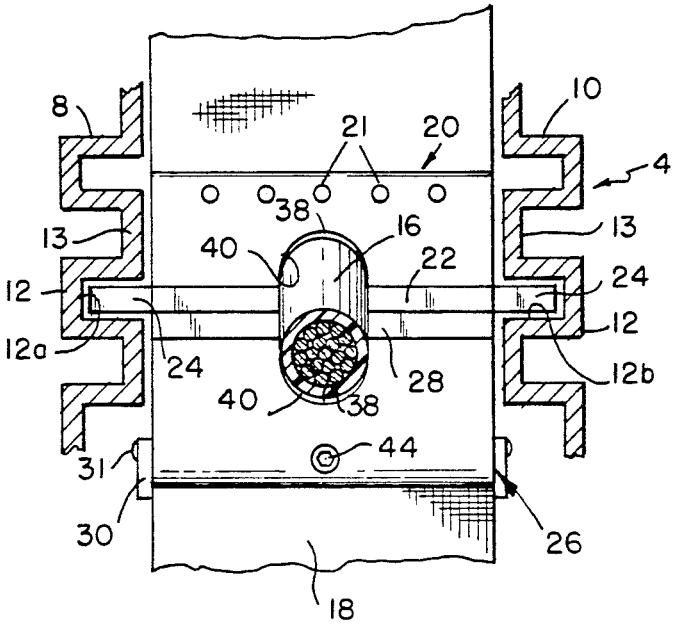
FIG. 5
FIG. 6
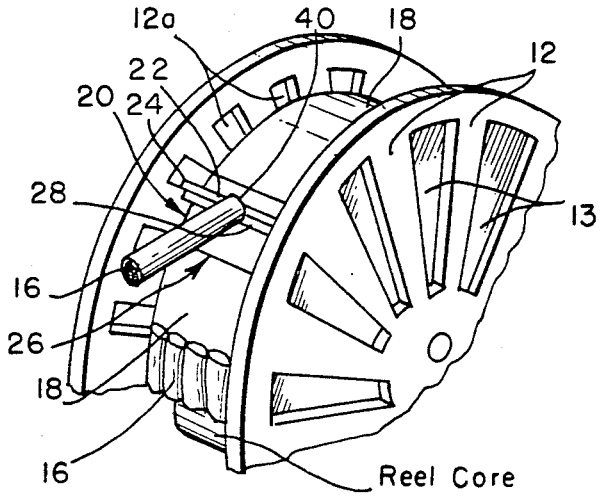

THEFT GUARD FOR CABLE REELS

BACKGROUND OF THE INVENTION

In the world of telecommunication, miles of multi pairs of single solid conductors are enclosed in a protective sheath which are strung on poles or buried in the ground. This cable is paid-off a huge reel holding miles of cable. Obviously only a limited length of the cable can be paid off the reel in any one work period. This presents a problem as to the cable remaining on the reel since it is a temptation to thievery, i.e., thieves cut the cable and steal that remaining on the reel. Note here that they do not steal the reel which is heavy and cumbersome and usually locked to the trailer that is supporting it. Instead the thieves unwind the cable from the reel, cut it and make off with the severed cable of valuable copper. The theft of the cable in and of itself is a loss of valuable copper, but a greater loss is sustained by the fact that to continue the cable laying project, a new cable must be spliced in at the cut. Hundreds of pairs of solid copper wires might have to be spliced at a labor loss of hundreds of man hours.

SUMMARY OF THE INVENTION

Telecommunication cable of the type described is wound on special reels having a central core and ends which are radially fluted to give them strength. The flutes provide the unique element for making this invention operable since a planar flexible belt of the invention is provided with transverse studs that extend into these flutes to limit circumferential motion while permitting radial motion, thereby effectively locking one end of the belt to the reel. The belt is provided with a fixed and an adjustable locking terminus permitting the belt length to be varied at will to adjust it to a length adequate to enclose the cable remaining on the reel. The locking elements have cooperating parts that form a bushing around that section of the cable that is just leaving the reel. Accordingly, at the end of a work day, the belt can be wrapped around the cable remaining on the reel to prevent its being unwound and stolen.

BRIEF DESCRIPTION OF THE DRAWINGS

FIG. 1 is a perspective view of a tractor laying cable;

FIG. 2 is a perspective view of a cable reel showing the fluted end flanges with the cable being paid out tangentially from the reel;

FIG. 5 is an illustration generally showing the cooperation of the locking elements with the reel, and, FIG. 6 is a fragmentary perspective view generally corresponding to FIG. 5 showing the cable guard associated with a cable wound about a reel.

DESCRIPTION OF THE PREFERRED EMBODIMENT

Figure 3:
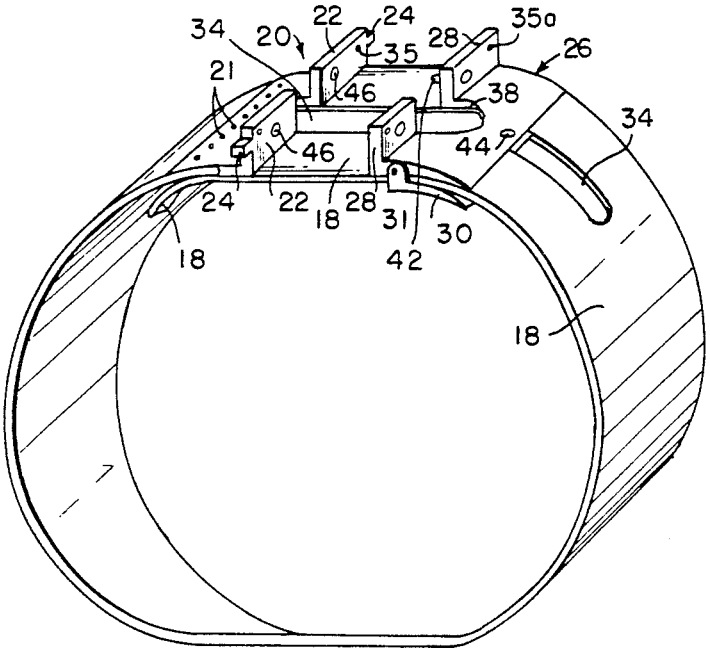
FIG. 3 is a perspective view of the reel guard, showing the fixed and adjustable terminus of the flexible belt.

Referring now to the drawings, and particularly FIG. 1, a huge bulldozer-tractor 2 with furrow plow is shown supporting a cable reel 4. In normal operations the tractor plows a furrow, lays the cable in the ground, and re-covers it with earth.

The cable reel 4 as seen in FIG. 2 comprises a central generally cylindrical core 6 which supports a pair of axially spaced end flanges 8, 10. Each flange is provided with a number of contiguous radially extending flutes 12, 13 which alternately are impressed in the flanges for strengthening purposes. Typically, flute 12 is impressed so that is extends axially away from the reel and the contiguous flute 13 is impressed so that it extends axially towards the opposite flange.

It is important to note that respective pairs of the outwardly extending flutes 12 in each flange are axially aligned to provide in effect a series of confronting pockets as at 12*a* and 12*b* in each flange.

The cable 16 comprises a protective sheath enclosing many pair of individually insulated solid copper wire, with each one pair providing telecommunication service to a customer.

The cable may be a mile or more long, depending of course on the diameter of the cable. The cable is paid out from the reel and either strung on poles, or preferably buried with the tractor-plow mechanism 2 shown.

At issue is the fact that in a day's work, only a portion of the cable is paid off the reel, leaving very valuable cable on the reel 4.

Thieves are not interested in stealing the reel 4 which is cumbersome and usually locked to the tractor. Instead, they cut the cable at its last exit from the ground and then unwind it from the reel, chopping it into lengths they can carry. After all, their only interest is the copper content of the cable.

To deter this thievery, I provide a flexible belt 18 (FIG. 3) of a general length equal to the circumference of a reel, and of a width approximately equal to the axial length of the core of the reel.

The belt preferably is made of a bonded wire reinforced fiberglass, which is intended to offer substantial resistance to vandalism and yet be flexible enough to be wrapped around the reel.

At one end of the belt a first or fixed locking member 20 is fixed to the belt 18 as by rivets 21 to provide one terminus for the belt. This first locking device is generally of a transverse length equal to the width of the belt and has a split upright flange 22 which is provided at each end with an integral outwardly extending stud 24 shaped to fit into the axially aligned outwardly impressed flute pocket 12*a* or 12*b* in the reel flanges 8, 10, and when so located lock the first locking member 20 to the flanges to prevent movement relative to the circumference of the reel while permitting radial movement in the generally radial flutes to permit the first locking device to slide down against the cable remaining on the reel, irrespective of the reel diameter of the remaining cable.

The belt 18 at its other end is equipped with a second and adjustable locking member 26 which again has a length equal to the width of the belt and an upstanding split flange 28 which is complementary to and can lie contiguous to the flange 22 on the fixed locking member. Further, the free end of the belt 18 is bifurcated as seen in FIG. 3 to define lateral portions 18*a*, 18*b* on either side of slot 34. Slot 34 is of a length such that the unslotted portion of belt 18 forms a loop approaching the diameter of core 6.

Figure 4:
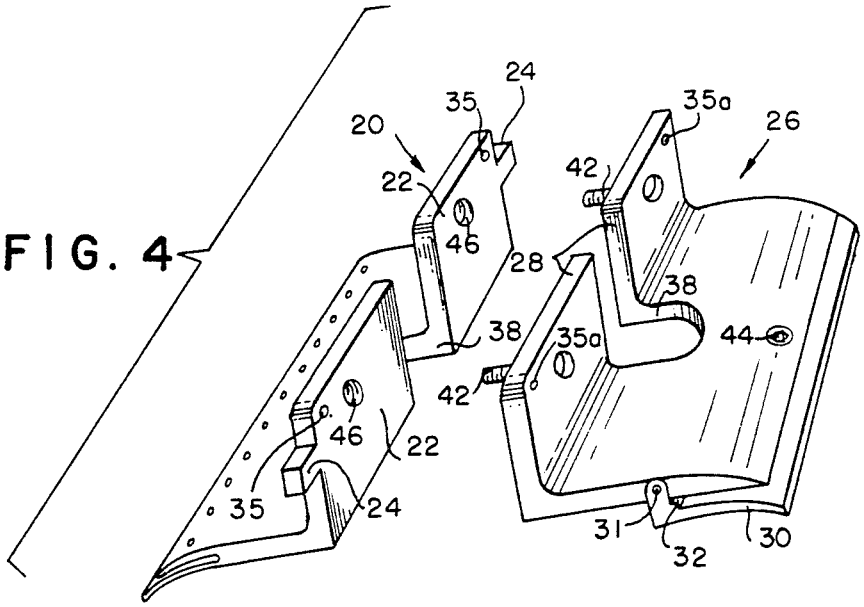
FIG. 4 is a perspective view of the fixed and adjustable locking members for the reel guard.

The locking device 26 is equipped as shown in FIG. 4 with a clamp 30 which is pivotally secured at 31 to the locking device 26 and has a length equal to the length of the locking device 26. The clamp 30 is equipped with serrations or grippers 32, intended to grip the belt. After the desired length of belt has been fed through the clamp 30, the same may be positively secured to the lower flange of L-shaped locking member 26, as by screw means 44 having a specialized head requiring a special tool to preclude tampering.

Specifically, when the clamp 30 is rotated to be at right angles to the locking device 26, the belt can be fed through the opening between the clamp 30 and the underside of the locking device. Such a clamp means is well known, for example, in seat belt constructions.

When a determined length of belt 18 is fed through, the clamp 30 is locked and the length of the belt is thus defined as being from the fixed locking device 20 to the adjustable locking device 26, which are moved into closely confronting relations. In this manner the length of the belt can be adjusted to accommodate the diminishing diameter of the reel as the cable is paid off.

Particular attention is now drawn to the semi-circular notches or bushings 38, 38, one provided on each of the locking devices 20, 26. The semi-circular notches 38, 38, when the belt is wrapped around the cable and the two locking devices 20, 26 are fixed in contiguous relationship, define an aperture 40 to surround the last section of the cable 16 being fed off the reel, and which extends therethrough, as seen in FIGS. 5 and 6. Depending upon the size of the cable, the same may also be gripped in the aperture 40.

With this construction, at the end of a work day belt 18 is wrapped around the cable remaining on the reel, the studs 24 are slid into the axially aligned outwardly extending flutes 12*a*, 12*b* to lock the fixed terminus 20 of the belt to the reel, then the adjustable end 26 is adjusted to complement the diameter of the cable on the reel and the two semi-circular bushings 38, 38 are aligned to envelop the last section of cable 16 leaving the reel as the locking devices 20, 26 are brought into contiguous relationship.

When so placed, the two locking devices are preferably fixed with special screws 42 received in threaded bores 46, which screws 42 can only be tightened, released or removed with a particular complementary tool.

In the alternative, a padlock may be passed through apertures 35, 35*a* provided in flanges 22, 28 to secure the two locking members together.

While I have discussed a preferred embodiment of my invention, modifications will occur to those skilled in the arts, and the following claims are intended to cover my invention in its broadest form.

What I claim is:

1. A theft guard for a cable reel having a core about which a cable is wound and having opposite radial end flanges with said end flanges having respective confronting recesses therein, comprising:

a flexible belt of a length generally sufficient to wrap circumferentially around a wound cable on a reel core, and of a width generally equal to that of the reel core, first and second locking means adjacent respective ends of said belt for securement to each other, said first locking means on one end of said belt being fixed thereto, and said second locking means on the other end of said belt having belt adjustment means for shortening of said belt with respect to said locking means to accommodate the diameter of a reel core wound cable at the time the belt is wrapped therearound, thereby to permit said belt to generally snugly embrace the wound cable and permit said first and second locking means to be in confronting relation irrespective of reel wound cable diameter, means for securing said first and second locking means together, and, said first and second locking means defining therebetween a generally radial opening through which a cable may generally tangentially extend when said belt is in locked position, whereby said belt when associated with a reel having a wound cable thereon blocks access to the wound cable to preclude unauthorized unreeling thereof.

2. The theft guard for a cable reel of claim 1 wherein said locking means include laterally protruding elements laterally engageable with the recesses of a said reel, thereby to preclude circumferential movement of said belt with respect to a cable reel when engaged therewith.

3. The theft guard for a cable reel of claim 2 wherein the recesses of the cable reel are of generally radial disposition, whereby said protruding elements of the theft guard may be engaged with said recesses irrespective of varying diameters of said wound cable.

4. The theft guard for a cable reel of claim 2 wherein said locking means each comprise L-shaped elements with one leg thereof cooperatively associated with said belt and the other leg defining an upstanding flange, one said flange having said protruding elements at opposite lateral ends thereof.

5. The theft guard for a cable reel of claim 4 wherein each said one leg further includes a U-shaped notch extending toward its associated said flange, and each said flange is divided into two portions, with one portion on each side of said notch.

6. The theft guard for a cable reel of claim 4 further including securing means which interconnects said flanges for securing the flanges together.

7. The theft guard for a cable reel of claim 6 wherein said securing means is a threaded connection.

8. The theft guard for a cable reel of claim 6 wherein said securing means is a padlock interconnecting said flanges.

9. The theft guard for a cable reel of claim 1 wherein said first and second locking means have respectively generally U-shaped notches therein disposed in confronting relation to each other, whereby when said locking means are secured to each other, said notches define said opening.

10. The theft guard for a cable reel of claim 9 wherein said belt other end is bifurcated thereby to preclude blocking said opening defined by said notches and through which a cable may extend.

11. The theft guard for a cable reel of claim 1 wherein said belt adjustment means includes means slidably mounting said second locking means on said belt, and means for releasably clamping said second locking means to said belt to prevent sliding therealong.

12. The theft guard for a cable reel of claim 1 wherein said belt is of rugged wire-reinforced material to preclude destruction by vandalism.

13. An anti-theft reel guard for particular use in combination with a wire cable reel constructed to have a central tubular core supporting at each end one of a pair of parallel axially spaced apart radially extending flanges each of which is strengthened against lateral deflection by a plurality or radially extending pocket-like flutes are formed in each flange with the flutes of each flange facing towards the other flange, comprising:

a flexible belt made of bonded wire-reinforced fiberglass, said belt having a width generally corresponding to the length of the core of the reel with which the theft guard is to be used, and a belt length generally corresponding to the circumference of the flanges of the reel with said belt being intended to be wrapped around and enclose the wound cable remaining on a reel at any one time, a first locking element having a length substantially equal to the width of said belt and fixedly secured thereto laterally across one end of said belt to define one terminus thereof, said first locking element having integral studs protruding perpendicularly beyond the lateral edges of said belt a distance sufficient to fit one stud respectively into each of an aligned and oppositely disposed flute in each of said flanges to lock one end of the belt to the reel to limit the circumferential motion of said first locking element relative to said flanges when the belt has been wrapped around the wound cable on a reel with the studs being inserted in the flutes, a second locking element having a width approximately the width of said belt, and having releasable locking means for clamping said second locking element onto said belt at a predetermined adjusted position and transverse thereto to define the effective length of the belt to be from the said first locking element to said second or adjustable locking element thus permitting the effective depth of the belt to be varied from a length substantially equal to the circumference of the reel flanges to a length equal to the circumference of the core to permit the belt to snugly surround the cable without regard to the quantity of cable remaining on the reel, means securing said first and second locking elements to each other in contiguous relation when the belt has been wrapped around the cable on the reel, and, said first and second locking elements in contiguous position defining together an aperture to surround a tangentially extending portion of the cable which has been paid off the reel when said belt is wrapped therearound, whereby said reel guard when locked around the cable remaining on the reel prevents the cable from being unwound from the reel while permitting additional unwinding of the cable from the reel when the reel guard has been removed.

14. A reel and cable theft guard therefore, comprising, a reel having a pair of reel flanges, each flange having a radially extending flute, a reel core axially separating and connected to said flanges at the core opposite ends, with the flange flutes facing toward each other, and, a length of electrical cable wound on said core and including a cable terminal end at the outermost winding, said theft guard having, a flexible belt of a length generally sufficient to wrap circumferentially around said wound cable on said reel core, and of a width generally equal to that of the reel core, first and second locking means adjacent respective ends of said belt for securement to each other with said belt wrapped about said cable, said first locking means on one end of said belt being fixed thereto, and said second locking means on the other end of said belt having belt adjustment means for shortening of said belt with respect to said locking means to accommodate the diameter of said wound cable at the time the belt is wrapped therearound, thereby to permit said belt to generally snugly embrace the wound cable and permit the first and second locking means to be in confronting relation irrespective of reel wound cable diameter, means for securing said first and second locking means together, and, said first and second locking means defining therebetween a generally radial opening through which said cable terminal end generally tangentially extends when said belt is in locked position, whereby said belt blocks access to the wound cable to preclude unauthorized unreeling thereof.

15. A theft guard for reel wound cable comprising a flexible abuse-resistant belt for wrapping around a core-wound cable, said belt having a substantially length and a width substantially in excess of the width of a cable with which the guard is to be employed, first and second locking means cooperatively associated with adjacent respective ends of said belt for securement to each other, one said locking means having belt adjustment means for effective shortening of said belt with respect to said one locking means to accommodate the diameter of a core-wound cable at the time the belt is wrapped therearound, thereby to permit said belt to generally snugly embrace the core-wound cable and permit said first and second locking means to be in confronting relation irrespective of reel wound cable diameter, means for securing said first and second locking means together, and, said first and second locking means defining therebetween a generally radial opening through which a cable terminal end may generally tangentially extend when said locking means are secured together, whereby said belt when installed blocks access to a reel wound cable to preclude unauthorized unreeling thereof.

* * * * *